US006784850B2

(12) United States Patent
Morooka et al.

(10) Patent No.: US 6,784,850 B2
(45) Date of Patent: Aug. 31, 2004

(54) ANTENNA APPARATUS

(75) Inventors: Tasuku Morooka, Tokyo (JP); Hisao Iwasaki, Tama (JP); Toshiyuki Haga, Saitama (JP); Yasushi Iitsuka, Ageo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/096,654

(22) Filed: Mar. 14, 2002

(65) Prior Publication Data

US 2003/0016185 A1 Jan. 23, 2003

(30) Foreign Application Priority Data

Jun. 27, 2001 (JP) ..... 2001-195051

(51) Int. Cl.[7] ..... H01Q 1/36
(52) U.S. Cl. ..... 343/895
(58) Field of Search ..... 343/895

(56) References Cited

U.S. PATENT DOCUMENTS 5,198,831 A * 3/1993 Burrell et al. ..... 343/895
6,421,028 B1 * 7/2002 Ohgren et al. ..... 343/895
6,421,029 B1 * 7/2002 Tanabe ..... 343/895

FOREIGN PATENT DOCUMENTS

JP 2001-102852 4/2001

* cited by examiner

*Primary Examiner*—Michael C. Wimer
(74) *Attorney, Agent, or Firm*—Oblon, Spivak, McClelland, Maier & Neustadt, P.C.

(57) ABSTRACT

Power is supplied to antenna elements of a helical antenna section, which are arranged at an angular distance of 90° therebetween, with a phase difference of 90°. When a reception wavelength is λ, the height of the helical antenna section is 0.6 λ to 0.75 λ, the number of turns, T, of each antenna element is about 1, and the pitch angle α of each antenna element is 50° to 60°. A straight portion with a length corresponding to ¼ of the height of the antenna section is formed at a location corresponding to ½ to ¾ of the height of the antenna section, the height of the antenna section is about 0.3 λ to 0.35 λ, the number of turns, T, is about 1, and the pitch angle α is about 22°.

9 Claims, 16 Drawing Sheets

Gain characteristics relative to desired angle θ with height H of antenna varied (D=20mm,T=1turn)

Relationship between antenna diameter D and directivity (gain pattern) (H=70mm,T=1turn)

Relationship between number of turns T and directivity (gain pattern) (D=20mm,H=70mm)

Relationship between number of turns T and axial ratio in coverage range of satellite (D=20mm,H=70mm)

Relationship between pitch angle α and directivity (gain pattern)
($L_F$=85mm,T=1turn)

Current distributions in conventional helical antenna and monopole antennas

Current distributions of helical antennas with pitch angle $\alpha$ used as parameter Relationship between the position of straight element and gain at desired angle
(H=40mm,D=29.17mm,T=3/4turns, $L_F$=85mm, $\alpha$=23.58°, $\phi$=0°)

Relationship between the position of straight element and gain at desired angle
(H=40mm,D=29.17mm,T=3/4turns, $L_F$=85mm, $\alpha$=23.58°, $\phi$=0°)

Directivity characteristics (gain pattern) relative to antenna height H
(T=1turn, $L_F$=85mm, $\phi$=0°)

Measured result of axial ratio pattern of helical antenna

H=34mm
D=20mm
T=1
W=2mm
LF=74.86mm
$\alpha$=22.6°
$\phi$80mm Reflection plate

ANTENNA APPARATUS

CROSS-REFERENCE TO RELATED APPLICATIONS

This application is based upon and claims the benefit of priority from the prior Japanese Patent Application No. 2001-195051, filed Jun. 27, 2001, the entire contents of which are incorporated herein by reference.

BACKGROUND OF THE INVENTION

1. Field of the Invention

The present invention relates generally to an antenna apparatus, and more particularly to an antenna apparatus suitable for an MSB (Mobile Satellite Broadcast) system.

2. Description of the Related Art

With an increase in the demand for communications, remarkable developments have been achieved in these years in the field of communication and broadcasting. In the near future, a mobile broadcasting system, which makes use of artificial satellites (hereinafter referred to as "satellites") such as broadcasting satellites and communications satellites, will be put to practical use.

In the mobile broadcasting system, it is important that radio waves from satellites can always be received by mobile stations in good condition. In big cities, however, high-rise buildings, etc. are obstacles to radio communication, and mobile stations are unable to directly receive radio waves from the satellites in most cases. To solve this problem, there is an idea that relay stations are disposed at locations open to the satellites without obstacles. Radio waves from the satellites are re-broadcast to ground areas via the relay stations. Thereby, the condition of radio reception by the mobile stations is always kept constant.

In addition, in this system, it is necessary to receive both radio waves from satellites and radio waves from relay stations with desired gains. Radio waves come from the satellites at a certain elevation angle, while radio waves come from the relay stations in the substantially horizontal direction. These matters, in particular, have to be considered in designing reception antennas.

In Japan, for example, a satellite is situated to have an angular range of 35° to 60° with respect to the zenith (0°). Thus, a reception antenna is required to have a performance capable of receiving radio waves from directions at these angles with a gain of about 2.5 dBi or more. In addition, the reception antenna is required to have a performance capable of receiving radio waves coming from the relay stations in a substantially horizontal direction with a gain of about 0 dBi.

Patch antennas designed for a GPS (Global Positioning System), etc. may possibly be applied to the antennas for the above system. However, the conventional antenna apparatus is specifically designed for receiving radio waves coming from the sky. The conventional antenna apparatus has a disadvantage that the reception gain in the horizontal direction is low.

To solve this problem, there is an idea that an additional antenna for receiving radio waves in the horizontal direction is provided. According to this solution, however, the cost rises, the size and weight of the antenna apparatus increase, and the external appearance is disadvantageously degraded. In particular, these drawbacks have to be eliminated in the case where the antenna apparatus is mounted on vehicles, etc.

As has been described above, the conventional antenna apparatus is specifically designed for receiving radio waves from satellites, and the gain of horizontal reception in this antenna apparatus is low. Thus, this antenna apparatus cannot suitably be applied to the next-generation mobile communication systems. Moreover, since the conventional antenna apparatus requires a purpose-specific antenna for obtaining a horizontal reception gain, the size, weight and cost will disadvantageously increase.

BRIEF SUMMARY OF THE INVENTION

The object of the present invention is to provide an antenna apparatus at low cost, which is capable of obtaining a reception gain in a desired range of elevation angles, without increasing the size and weight of the apparatus.

In order to achieve the above object, this invention may provide an antenna apparatus comprising: a base plate having one surface provided with a ground conductor; a helical antenna section attached to the base plate and provided with an n-number of antenna elements helically formed at an angular distance of (360/n)° therebetween; and a radio frequency signal supplier which is provided on the other surface of the base plate and supplies power to the n-number of antenna elements of the helical antenna with a phase difference of (360/n)°.

In this antenna apparatus, it is preferable that the helical antenna section may comprise a four-wire helical antenna having four antenna elements arranged at an angular distance of 90° therebetween, and that the radio frequency signal supplier supply power to the four antenna elements of the helical antenna section with a phase difference of 90°.

It is preferable that when a reception wavelength is λ, the height of the helical antenna section be 0.6 λ to 0.75 λ. It is also preferable that the number of turns of each antenna element be about 1. It is also preferable that each antenna element of the helical antenna section have a pitch angle of about 50° to 60°.

In this invention, each of the antenna elements may include a straight portion extending parallel to the axis of the helical antenna.

Preferably, the straight portion is formed with a length corresponding to about ¼ of the height of the helical antenna section at a location corresponding to ½ to ¾ of the height of the helical antenna section from the ground conductor. Preferably, when a reception wavelength is λ, the height of the helical antenna section is about 0.3 λ to 0.35 λ. More preferably, the height of the helical antenna section is about 0.34 λ. Preferably, the number of turns of each antenna element is about 1. Preferably, each antenna element of the helical antenna section has a pitch angle of about 22°.

Moreover, in this invention, the helical antenna section may be attached to a surface of the base plate, on which the radio frequency signal supplier is provided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will now be described with reference to the accompanying drawings.

Figure 1:
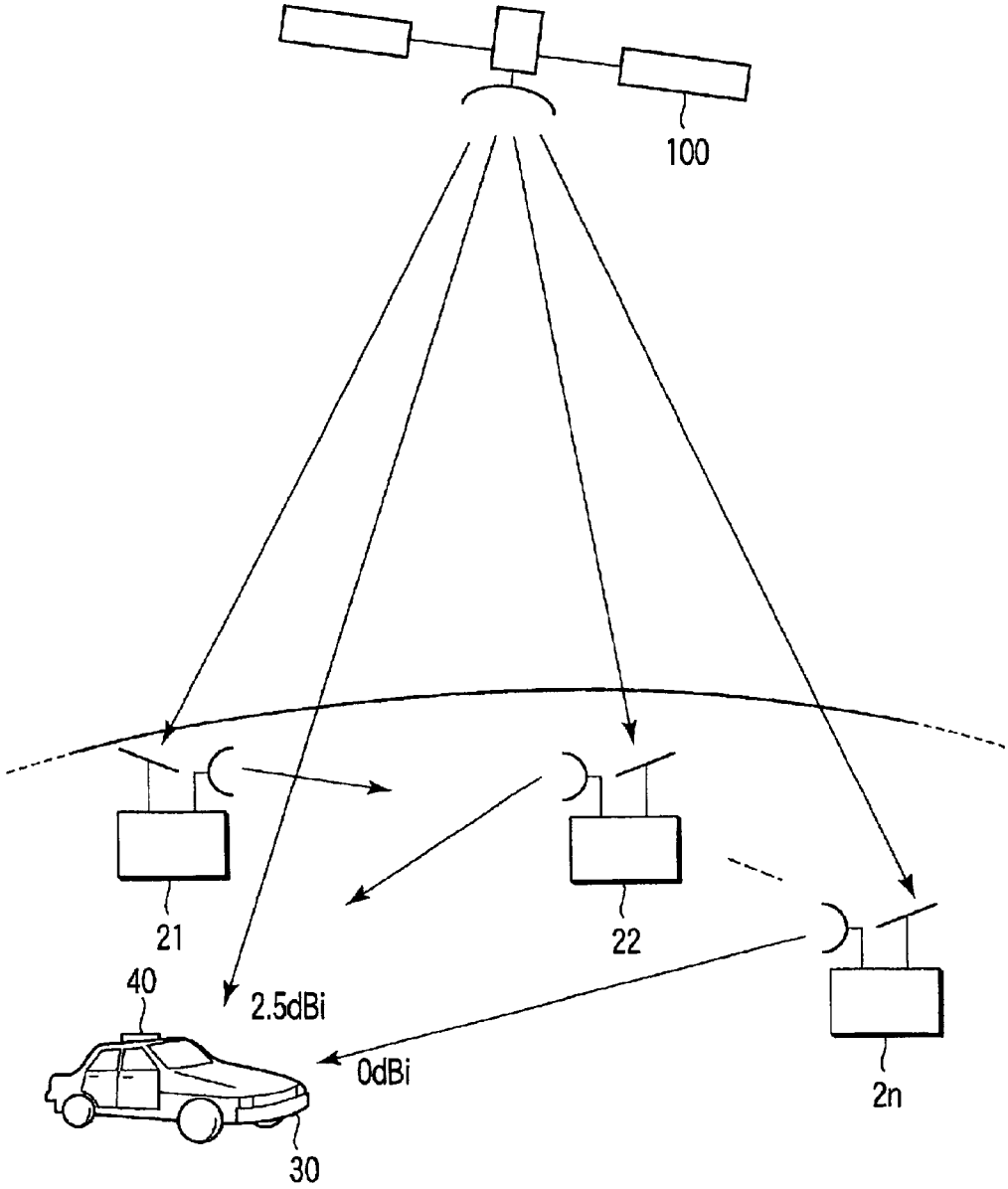
FIG. 1 shows the structure of an MSB system in which an antenna apparatus according to an embodiment of the present invention is applied.

FIG. 1 shows the structure of an MSB (Mobile Satellite Broadcast) system in which an antenna apparatus according to an embodiment of the present invention is applied. In FIG. 1, radio frequency signals emitted from a broadcasting satellite 100 are received by a vehicle 30 and a plurality of gap fillers 21–2*n*, which are present on the ground. The gap fillers 21–2*n* amplify the received signals, shape the waveforms of the signals, and retransmit the radio signals to predetermined areas. Thus, a service area of a predetermined size is created on the ground.

The vehicle 30 can receive radio waves from the broadcasting satellite 100 at a place open to the broadcasting satellite 100 without obstacles. On the other hand, the vehicle 30 receives radio waves retransmitted from the gap filler 2*n*, for instance, at a shadowy place, i.e. a place not open to the broadcasting satellite 100. The technical requirement in this case is that the gain of radio wave reception from the broadcasting satellite 100 should be 2.5 dBi or more and the gain of radio wave reception from the gap filler should be 0 dBi or more. An antenna apparatus 40 according to the present invention is attached to, for example, to the top portion of the vehicle 30.

The center frequency of the communication band used in the MSB system is 2.6425 GHz, which corresponds to a wavelength λ=115 mm.

First to third embodiments of the present invention will now be described.

(First Embodiment)

Figure 2:
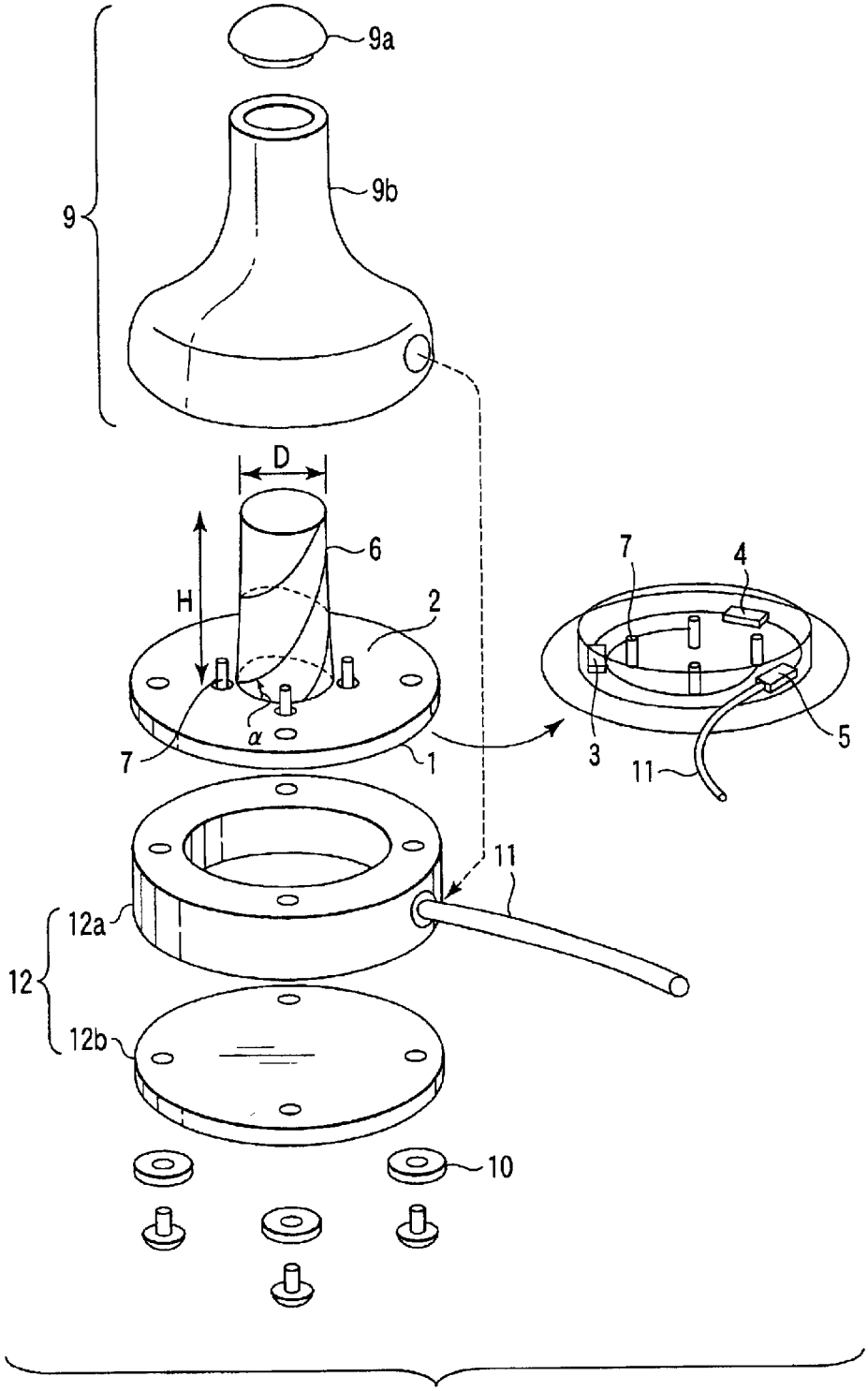
FIG. 2 shows the structure of an antenna apparatus according to a first embodiment of the invention.

FIG. 2 shows the structure of an antenna apparatus according to a first embodiment of the invention. The antenna apparatus comprises a dielectric base plate 1, a helical antenna 6 and a radome 9. The dielectric base plate 1 is placed on an upper support member 12*a*. The helical antenna 6 is attached to the dielectric base plate 1.

Magnets 10 for fixing the antenna apparatus shown in FIG. 2 to the vehicle 30 are attached to a bottom support member 12*b*. The number of magnets 10 is not limited, nor is the size of each magnet 10 limited. It should suffice if the magnets 10 can fix the antenna apparatus 40 to the vehicle 30 against the wind pressure at the time of driving.

A ground conductor plate 2 is formed on one surface of the dielectric base plate 1. The ground conductor plate 2 has a substantially circular shape. The helical antenna 6 is attached to that side of the dielectric base plate 1, where the ground conductor plate 2 is formed. The other side of the dielectric base plate 2 is provided with a power supply circuit 3, a low noise amplifier (LNA) 4 and a receiving circuit 5. A shield for electrically shielding the power supply circuit 3, LNA 4 and receiving circuit 5 is constituted by the support member 12.

The helical antenna 6 is connected to the power supply circuit 3 via connection pins 7. Radio waves coming to the helical antenna 6 are amplified by the LNA 4 and received by the receiving circuit 5. The received signal is sent out from the receiving circuit 5 to a tuner (not shown), etc. over a cable 11.

The helical antenna 6 is a so-called four-wire helical antenna wherein four antenna elements are arranged on a cylindrical body with an angular interval (i.e. angular distance) of 90°. The power supply circuit 6 supplies power to the antenna elements of helical antenna 6 with a phase difference of 90°.

The radome 9 covers the helical antenna 6 and dielectric base plate 1. The radome 9 comprises a cap 9*a* and a cover 9*b*. The cover 9*b* holds the helical antenna 6 in the fixed state, thus preventing adverse effect due to vibration, etc. inherent to vehicles. The shape of the cover 9*a* is not limited, if the cover 9*a* can reduce the adverse effect of wind pressure.

When the dielectric base plate 1 is attached to the support member 12*a*, the power supply circuit 3, LNA 4 and receiving circuit 5 are covered by the support member 12*a*. Preferably, the upper support member 12*a*and bottom support member 12*b* should be subjected to waterproof treatment to protect electronic parts from rain, etc.

In the present embodiment, assume that the diameter D of the ground conductor plate 2 is about 7/10 to 9/10 of a reception wavelength λ. In the MSB, λ=115 mm, so the diameter d is about 80 to 100 mm. This setting of the size is preferable in order to minimize the effect due to reflected waves from the roof of the vehicle 30 when the antenna apparatus 40 is attached to the roof.

Figure 3:
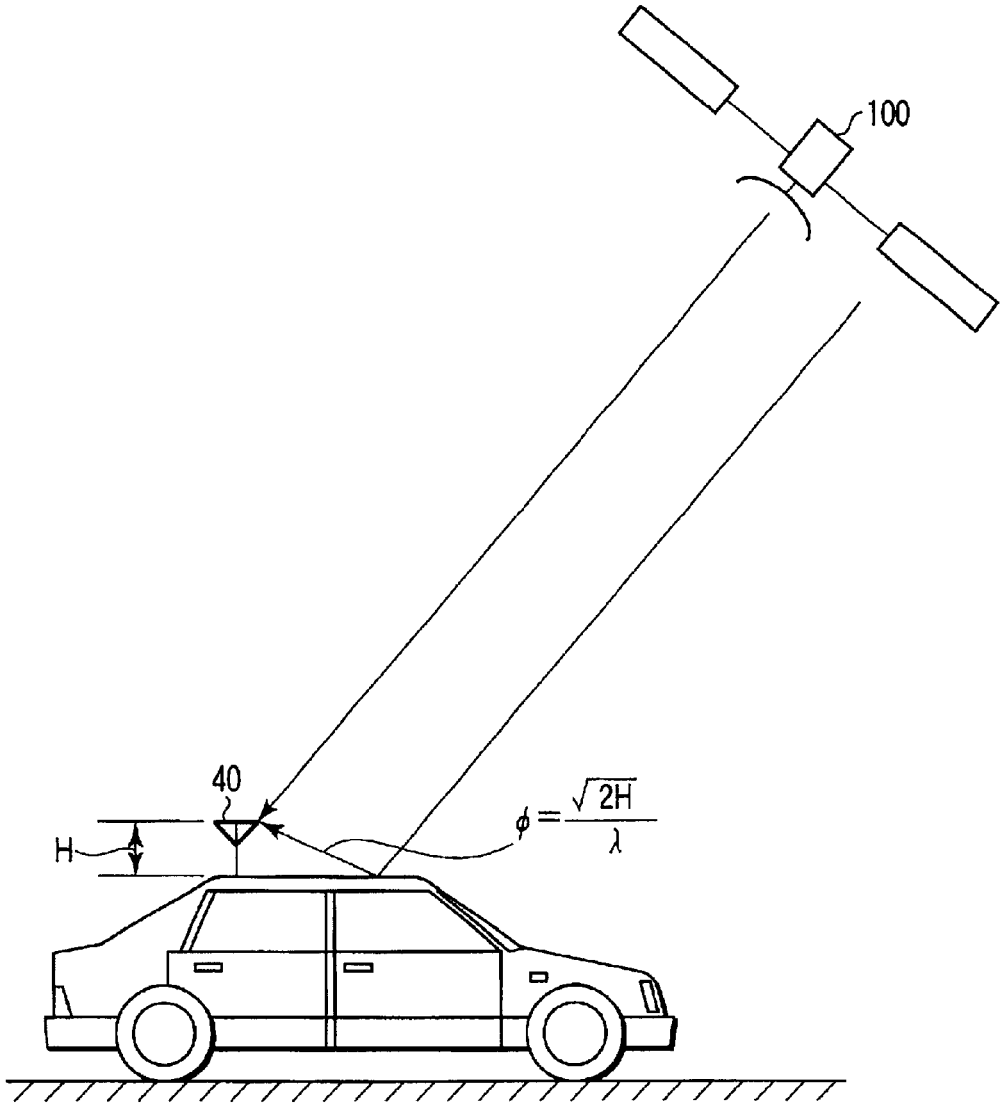
FIG. 3 is a view for explaining the effect of reflected waves from a vehicle 30.

As is shown in FIG. 3, the radio waves coming to the antenna apparatus 40 include a component coming directly from the broadcasting satellite 100 (hereinafter referred to as "desired wave component") and a component reflected by the roof of the vehicle 30 ("reflected wave component"). The polarization of the reflected wave component is opposite to that of the desired wave component. The phase of the reflected wave component is different from that of the desired wave component. Thus, the reflected wave component interferes with the desired wave component. This phenomenon poses a serious problem when the radiation directivity of the antenna apparatus 40 toward the roof of vehicle 30 is high. For the antenna apparatus 40 used in the MSB, it is thus necessary to increase a horizontal radiation level, while minimizing radiation toward the vehicle.

In general, the radiation directivity of the antenna apparatus depends greatly upon the size of the ground conductor plate 2 formed on the dielectric base plate 1. If it is supposed that the size of the ground conductor plate 2 is infinite, the radiation direction of radio waves is limited to the antenna side, and no radiation occurs to the ground conductor plate 2 side. Consequently, the antenna gain in the horizontal direction decreases. On the other hand, if the size of the ground conductor plate 2 is decreased, the level of radiation toward the ground conductor plate 2 increases and the level of radiation to the front side of the antenna decreases. It is thus understood that the size of the ground conductor plate 2 has an optimal value.

Experiments conducted by the inventors of the present invention showed that good characteristics were obtained when the diameter of the ground conductor plate 2 was about 0.5 to 1.0 λ.

The characteristics of the antenna apparatus 40 according to the embodiment will now be explained referring to FIGS. 4 to 10.

Figure 4:
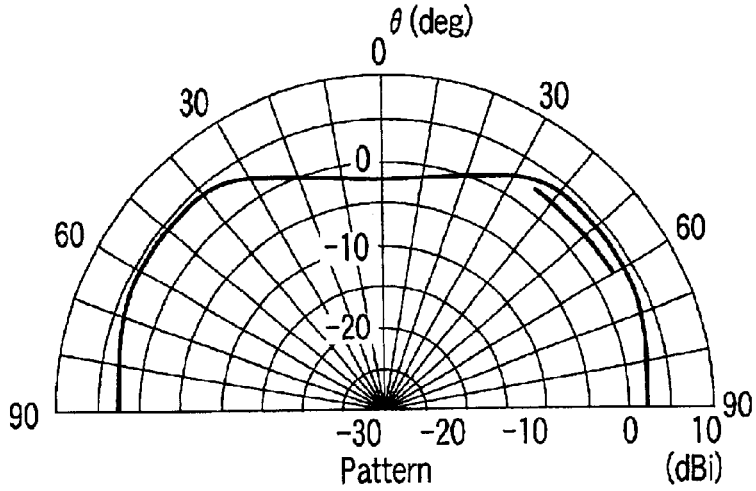
FIG. 4 is a graph showing characteristics required in an antenna apparatus for use in the MSB system.

FIG. 4 is a graph showing characteristics required in the antenna apparatus for use in the MSB system. FIG. 4 demonstrates that a reception gain of 2.5 dBi or more needs to be obtained in the angular range of 35° to 60° with respect to the zenith (0°), and a gain of about 0 dBi needs to be obtained in the substantially horizontal direction.

Figure 5:
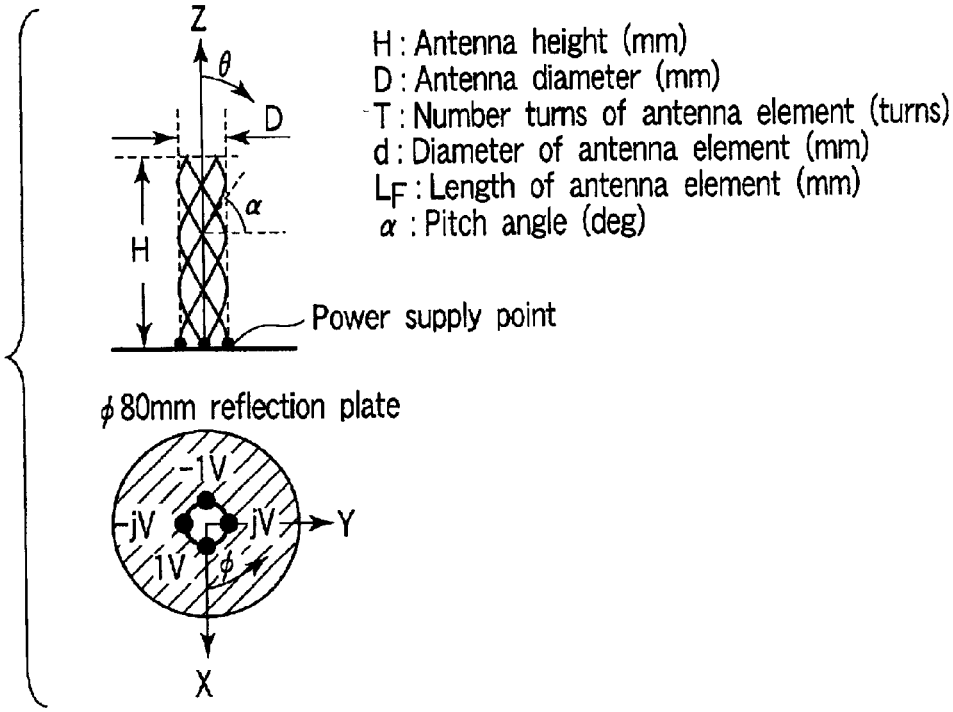
FIG. 5 shows characteristics of a four-wire helical antenna shown in FIG. 2.

FIG. 5 shows the structure and parameters of the four-wire helical antenna 6. In this embodiment, the parameters shown in FIG. 5 are also used in the graphs of FIG. 6 and the following. In FIG. 5, assume that the height of the helical antenna is H, the diameter of the helical antenna is D, the number of turns of the antenna element is T, and the pitch angle of the antenna element is α. In addition, the diameter of the ground conductor plate 2 is 80 mm. The frequency of received waves is 2.6425 GHz that is the center frequency. This frequency corresponds to a wavelength λ=115 mm.

Figure 6:
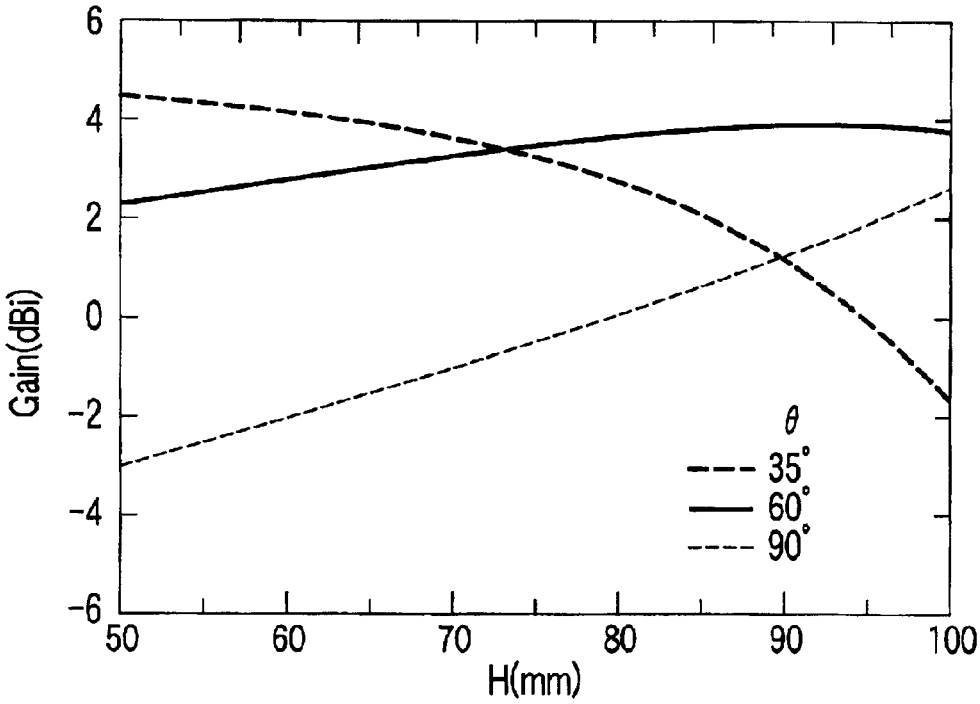
FIG. 6 is a graph showing gain characteristics relative to an angle θ when the height H of the antenna is varied, under the condition that T=1 and D=20 mm.

FIG. 6 is a graph showing gain characteristics relative to an angle θ when the height H of the antenna is varied, under the condition that T=1 and D=20 mm. FIG. 6 demonstrates that the height H of the antenna needs to be about 70 mm to 85 mm in order to obtain characteristics required when the angle θ is 35°, 60°or 90°. This antenna height H corresponds to 0.6 λ to 0.75 λ.

Figure 7:
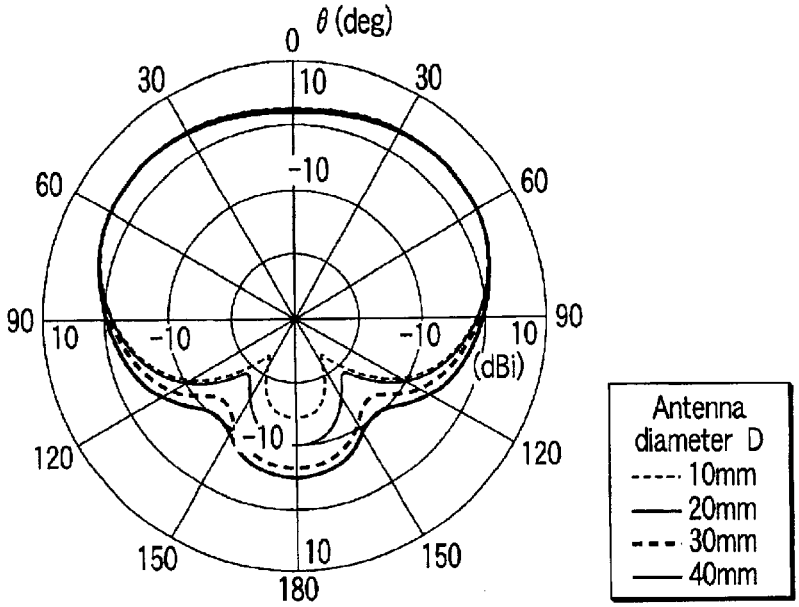
FIG. 7 is a graph showing the relationship between the diameter D of the antenna and the directivity.

FIG. 7 is a graph showing the relationship between the diameter D of the antenna and the directivity. FIG. 7 explains that as the diameter D increases, the radiation in the 180° direction, i.e. toward the roof of the vehicle 30, increases accordingly. In short, the larger the antenna diameter D, the greater the effect of the roof. It is thus preferable to decrease the antenna diameter D.

Figure 8:
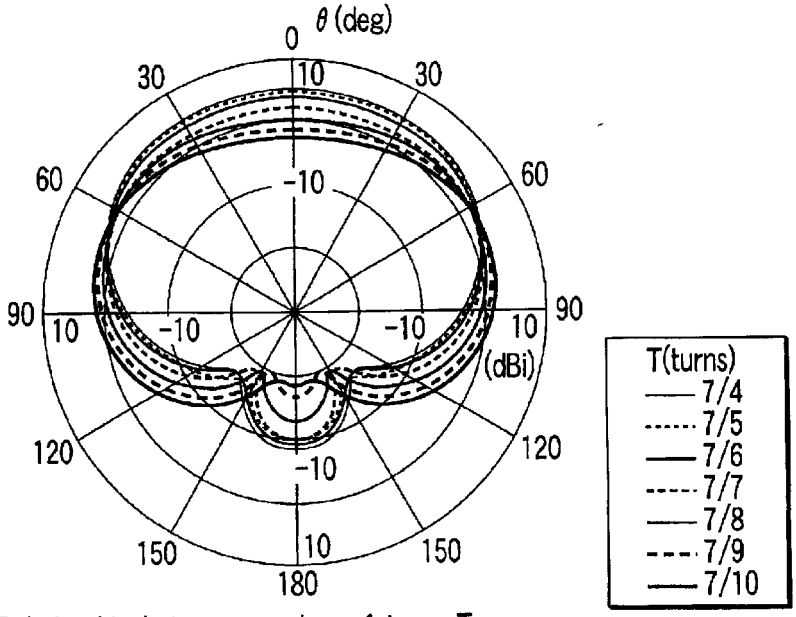
FIG. 8 is a graph showing the relationship between the number of turns, T, of the antenna element and the radiation directivity.

FIG. 8 is a graph showing the relationship between the number of turns, T, of the antenna element and the radiation directivity. FIG. 8 indicates that the radiation toward the front side increases as the number of turns, T, increases. Thus, it turns out that the required value is satisfied if the number of turns, T, is set at about 1.

Figure 9:
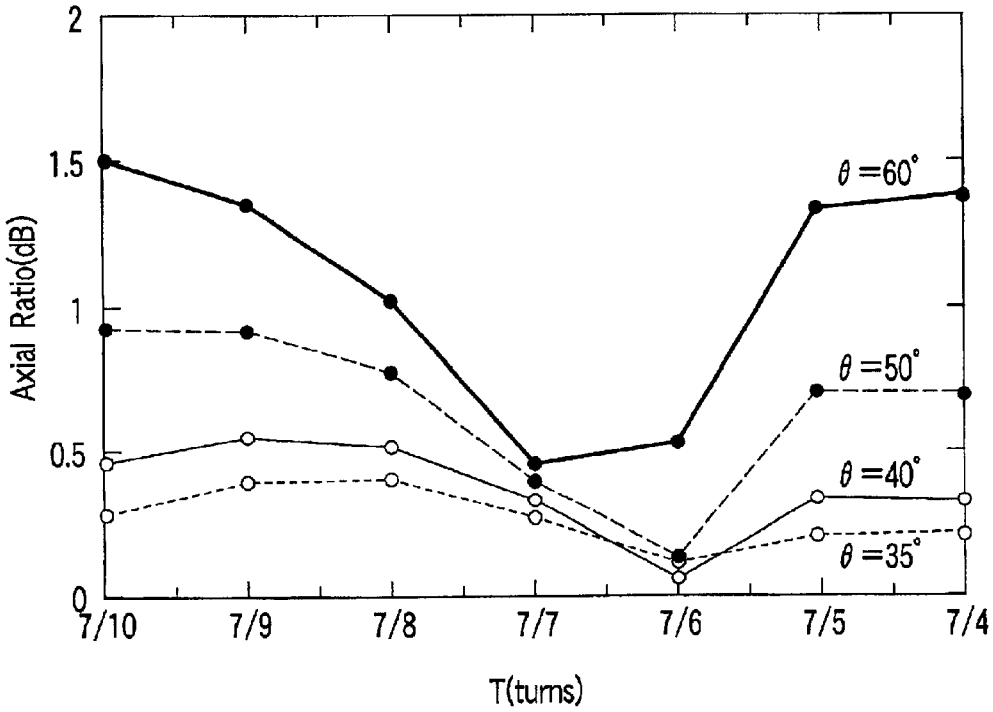
FIG. 9 is a graph showing the relationship between the number of turns, T, of the antenna element and the axial ratio in the range of angles of θ=35° to 60° corresponding to the coverage range of the satellite.

FIG. 9 is a graph showing the relationship between the number of turns, T, of the antenna element and the axial ratio in the range of angles of θ=35° to 60° corresponding to the coverage range of the satellite. In FIG. 9, too, it is indicated that a good axial ratio is obtained if the number of turns, T, is set at about 1.

Figure 10:
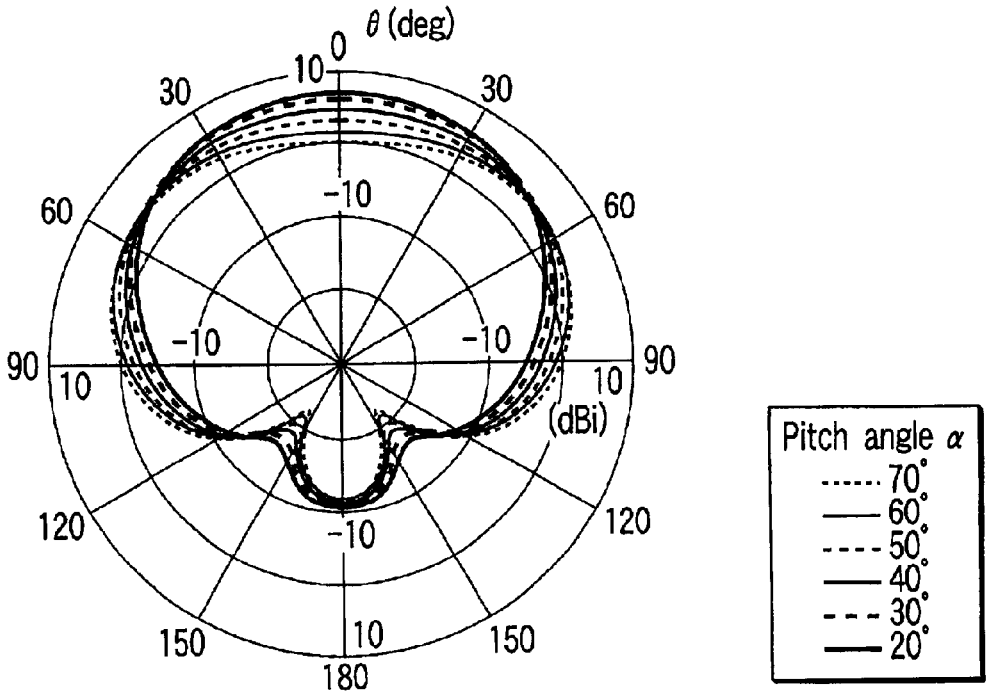
FIG. 10 is a graph showing the relationship between the pitch angle α of the antenna element and the radiation directivity.

FIG. 10 is a graph showing the relationship between the pitch angle α of the antenna element and the radiation directivity. FIG. 10 demonstrates that as the pitch angle α is increased, the gain in the forward direction decreases and the gain in the 90° direction increases. It is also clear that the required value is satisfied if the pitch angle α is set at about 50° to 60°.

It was thus clarified that in the antenna apparatus 40 of this embodiment the respective parameters should advantageously be set at the following values. Specifically, in the antenna apparatus 40 of this embodiment, when the reception wavelength is λ, the height H of the helical antenna section is set at 0.6 λ to 0.75 λ. In addition, the number of turns, T, of the antenna element is set at about 1, and the pitch angle α is set at 50° to 60°.

By thus setting the parameters, there is provided an antenna apparatus capable of most efficiently receiving radio waves in the MSB system in Japan.

(Second Embodiment)

Figure 11:
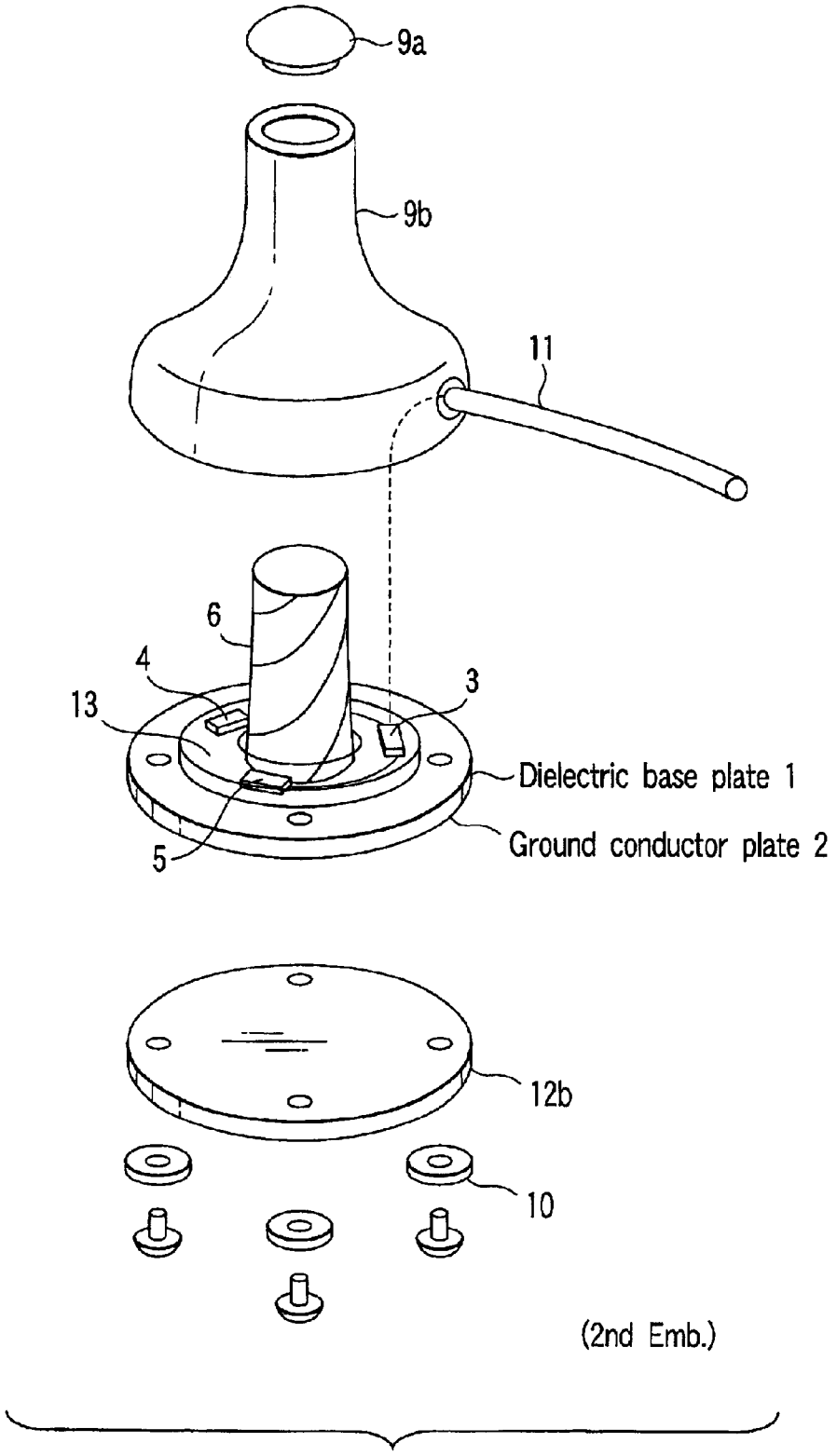
FIG. 11 shows the structure of an antenna apparatus according to a second embodiment of the invention.

A second embodiment of the present invention will now be described. FIG. 11 shows the structure of an antenna apparatus 40 according to the second embodiment of the invention. The antenna apparatus 40 shown in FIG. 11 has the same antenna parameters as the antenna apparatus 40 shown in FIG. 2. In FIG. 11, the same parts as shown in FIG. 2 are denoted by like reference numerals.

In FIG. 11, the helical antenna 6 is provided on that side of the dielectric base plate 1, on which the power supply circuit 3, LNA 4 and receiving circuit 5 are provided. In short, the helical antenna 6 is attached to that side of the dielectric base plate 1, which is opposite to the side thereof with the ground conductor plate 2.

According to this structure, the power supply circuit 3, LNA 4 and receiving circuit 5 are covered by the radome 9*a*, and the upper support member 12*a* shown in FIG. 2 can be dispensed with. Therefore, in this embodiment, compared to the structure of FIG. 2, the height of the whole antenna apparatus can be reduced. Specifically, in the structure of FIG. 2, the region including the power supply circuit 3, LNA 4 and receiving circuit 5 is exposed to the roof side of vehicle 30, and the height of the whole apparatus increases by this much. By contrast, according to the present embodiment, the height of the whole apparatus can be decreased, and thus the size of the apparatus reduced.

(Third Embodiment)

Figure 12:
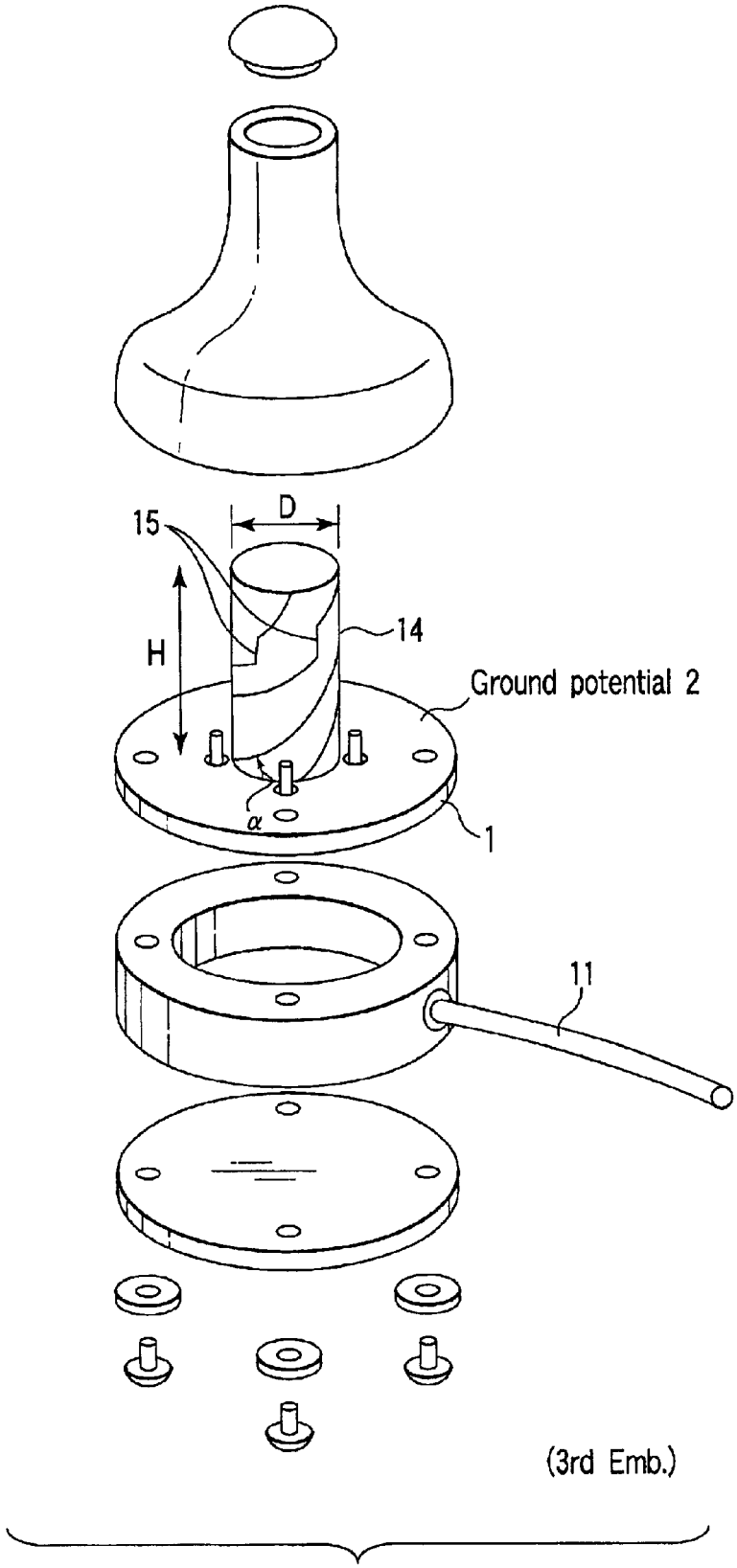
FIG. 12 shows the structure of an antenna apparatus according to a third embodiment of the invention.

A third embodiment of the present invention will now be described. FIG. 12 shows the structure of an antenna apparatus according to the third embodiment of the invention. In FIG. 12, the same parts as shown in FIG. 2 are denoted by like reference numerals. The antenna apparatus 40 shown in FIG. 12 differs from the antenna apparatus of FIG. 2 with respect to the structure of the helical antenna 6. In FIG. 12, the helical antenna is denoted by numeral 14 for the purpose of clear distinction.

The helical antenna 14 shown in FIG. 12 includes straight elements 15 as portions of the antenna elements. The straight elements 15 are formed parallel to the axial direction of the helical antenna 14. Specifically, antenna elements of an ordinary helical antenna are helically wound on a cylindrical body, whereas the straight elements 15 extend parallel to the axis of the cylindrical body.

In this embodiment, the length of each straight element 15 is set at about ¼ of the height H of the antenna. In addition, the straight element 15 is situated at a level corresponding to ½ to ¾ of the height of the antenna, relative to the ground conductor plate 2.

The advantages obtained with the antenna apparatus having the above-described structure will now be described.

Figure 13:
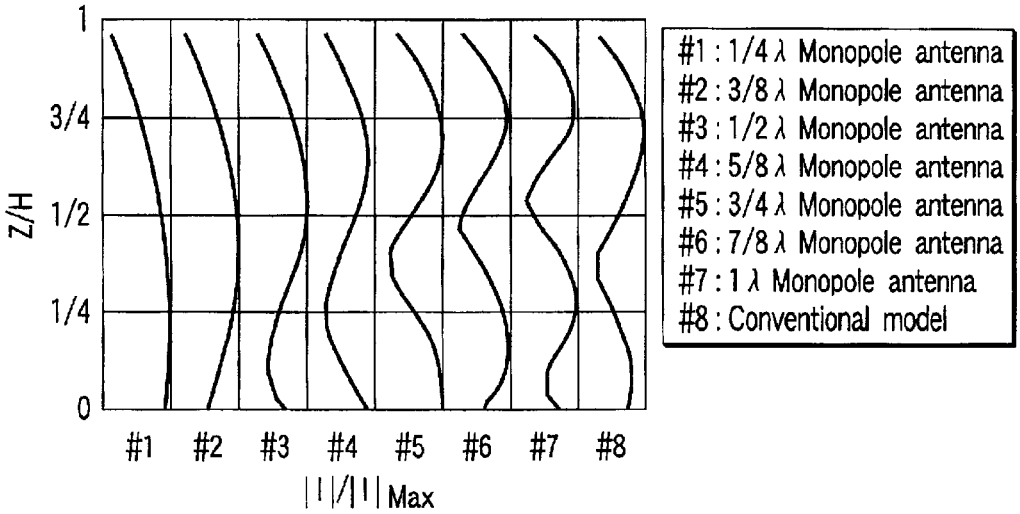
FIG. 13 is a graph showing, in comparison, a current distribution in a conventional helical antenna and current distributions in monopole antennas relative to their length.

FIG. 13 is a graph showing, in comparison, a current distribution in a conventional helical antenna (hereinafter referred to as "conventional model") using the same parameters as mentioned above and current distributions in monopole antennas relative to their length. In FIG. 13, the current distribution of the monopole antenna indicated by #5 is substantially equal to the current distribution of the conventional model (element length: about ¾ λ)

It is understood from above that a desired directivity can be obtained by setting the length of the antenna element of the helical antenna at about ¾λ. Table 1 below shows the relationship between the antenna diameter D and the antenna height H in a case where the length of the antenna element is set at ¾ λ and the number of turns of the antenna element is set at 1.

TABLE 1

| α (deg) | D (mm) | H (mm) |
|---|---|---|
| 70 | 9.25 | 79.87 |
| 60 | 13.53 | 73.61 |
| 50 | 17.39 | 65.11 |
| 40 | 20.73 | 54.64 |
| 30 | 23.43 | 42.50 |
| 20 | 25.42 | 29.07 |

Figure 14:
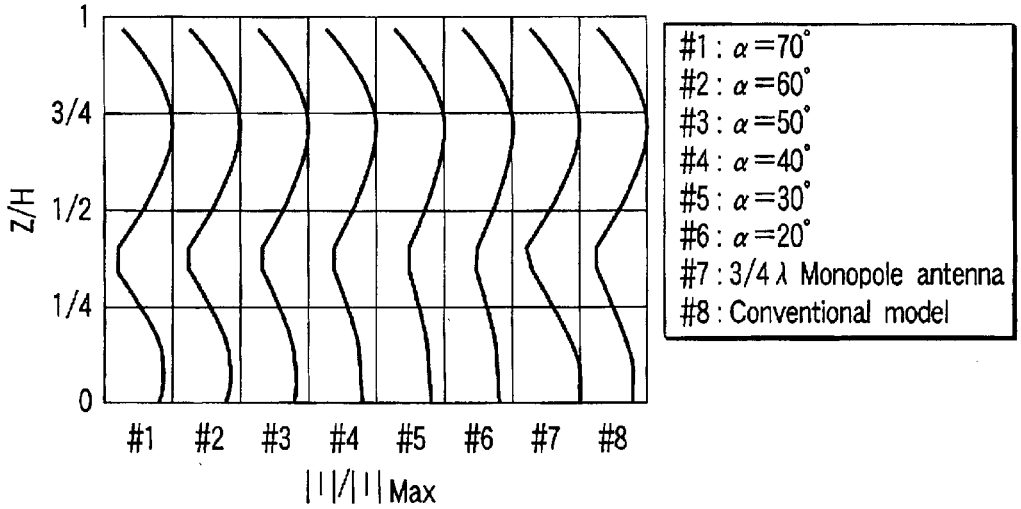
FIG. 14 is a graph showing current distributions of helical antennas, with the pitch angle α used as a parameter.

FIG. 14 is a graph showing current distributions of helical antennas, with the pitch angle α used as a parameter. In FIG. 14, the current distributions and directivity of the helical antennas indicated by #2 and #3, whose pitch angles α are in the range of 50° to 60° are substantially equal to the current distribution (#8) of the antenna of the conventional model.

When the length and the number of turns, T, of the antenna element are determined, the height of the antenna can be made smaller as the pitch angle α decreases. This is advantageous in reducing the size of the antenna apparatus. However, if the pitch angle α is too small, as shown in FIG. 9, desired directivity cannot be obtained. Thus, in the present embodiment, as shown in FIG. 12, it is proposed that the straight elements, whose length is about ¼ of the antenna height H, should be inserted in the helical antenna elements.

Figure 15:
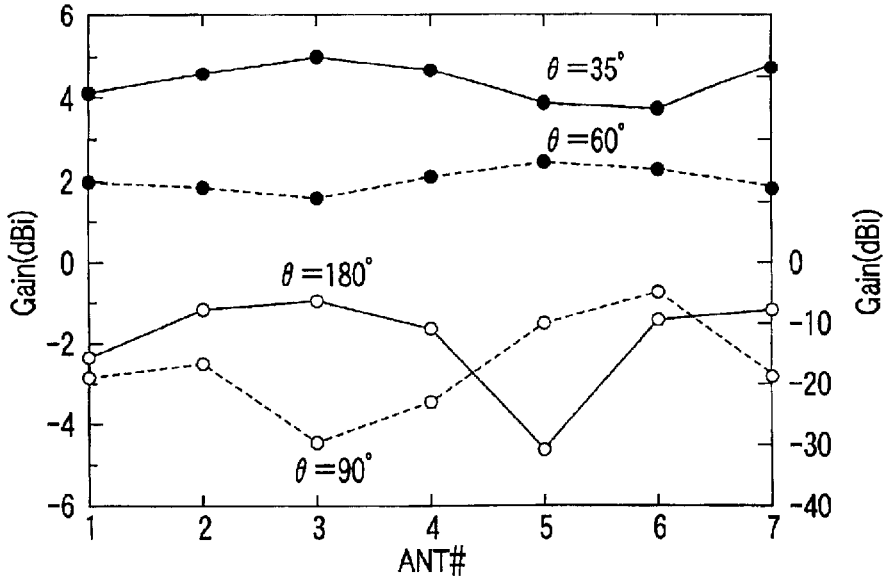
FIG. 15 is a graph showing the relationship between the position of a straight element and a gain in the case where the height H of the antenna is H=40 mm.
Figure 16:
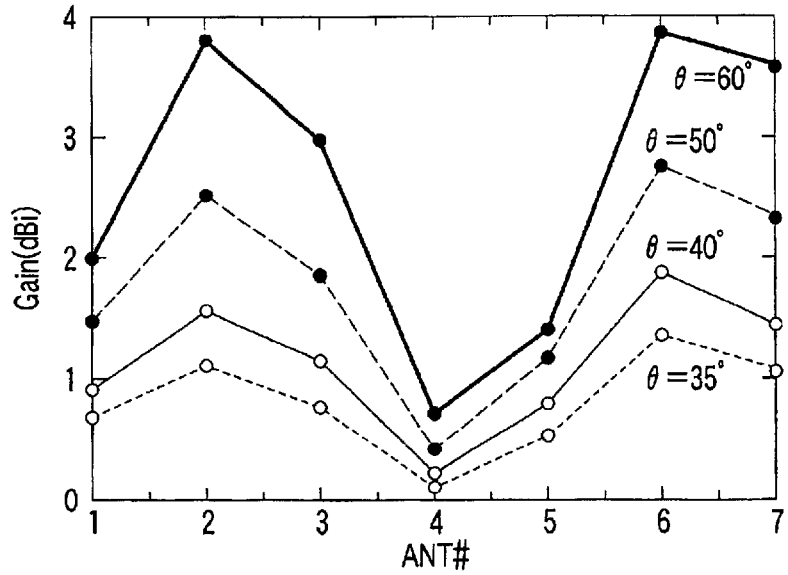
FIG. 16 is a graph showing the relationship between the position of a straight element and an axial ratio in the case where the height H of the antenna is H=40 mm.

FIG. 15 is a graph showing the relationship between the position of the straight element and the gain in the case where the height H of the antenna is H=40 mm. FIG. 16 is a graph showing the relationship between the position of the straight element and the axial ratio in the case where the height H of the antenna is H=40 mm. In both Figures, the abscissa indicates positions on the straight element. In addition, in both Figures, symbols #1, #2, . . . ,#7 (ANT#) indicate positions on the straight element, which are successively shifted from the bottom side of the antenna in units of ⅛. Table 2 below shows the relationship between ANT# and the position of the straight element from the bottom side of the antenna.

TABLE 2

| ANT# | Position |
|---|---|
| 1 | 0 to ¼ |
| 2 | ⅛ to ⅜ |
| 3 | ¼ to ½ |
| 4 | ⅜ to ⅝ |
| 5 | ½ to ¾ |
| 6 | ⅝ to ⅞ |
| 7 | ¾ to 1 |

FIG. 15 shows that desired gains are obtained at positions #5 and #6 when θ=35°, 60° or 90°. As regards position #6, the gain of backward radiation (i.e. θ=180°) is large. FIG. 16 shows that good axial ratios are obtained with positions #4 and #5 in the coverage range of the satellite. It is understood from these results that the required value is satisfied at the position #5, that is, when the straight element is inserted at the position corresponding to about ½ to ¾ from the bottom of the antenna.

Figure 17:
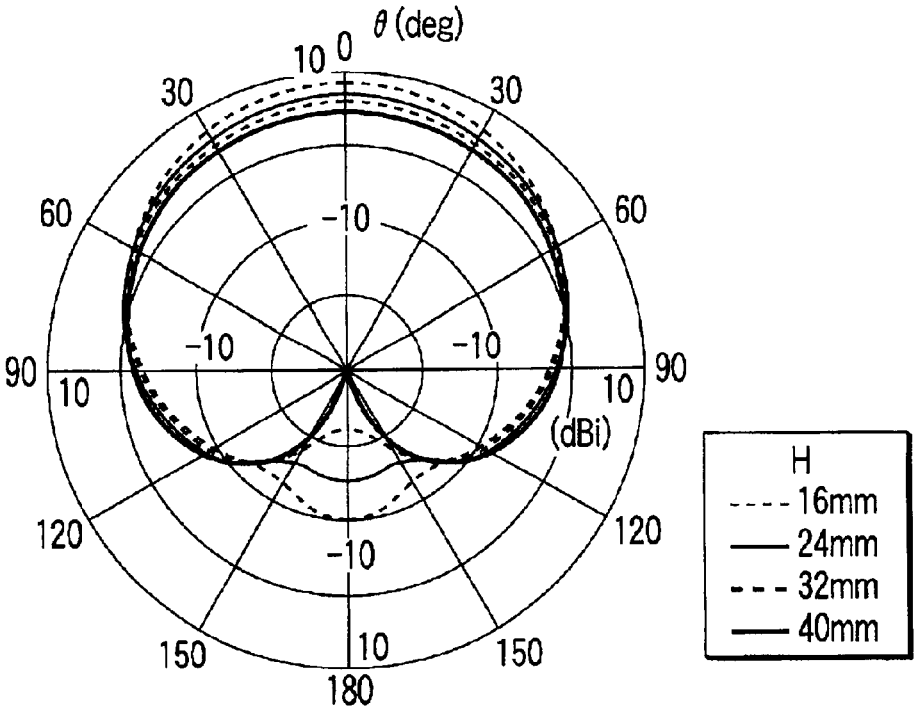
FIG. 17 is a graph in which directivity characteristics are plotted relative to the height H of the antenna shown in FIG. 12.

FIG. 17 is a graph in which directivity characteristics are plotted relative to the antenna height H in the present embodiment. Table 3 shows the antenna diameter D and pitch angle α relative to the antenna height H.

TABLE 3

| H (mm) | D (mm) | α (deg) |
|---|---|---|
| 40 | 29.17 | 23.58 |
| 32 | 31.05 | 18.16 |
| 24 | 32.65 | 13.17 |
| 16 | 34.00 | 8.52 |

FIG. 17 demonstrates that a forward gain and a backward radiation increase when the antenna height H is set at 16 mm. If the antenna height H is set at 40 mm, a backward radiation level can be decreased.

In brief, according to the present embodiment, the straight elements 15 are formed as portions of the antenna elements of the helical antenna 14. Thereby, the antenna height H can be reduced to about 40 mm, and further size reduction is achieved. Specifically, the height H of helical antenna 14 is set at about 0.3 λ to 0.35 λ, and the pitch angle α is set at about 22°.

The above-described embodiment, too, can provide an antenna apparatus capable of efficiently receiving radio waves from the broadcasting satellite 100 and gap fillers 21 to **2*n*** in the MSB system. Furthermore, since the height H of the helical antenna can be set at about 40 mm, a vehicle antenna with a low height and a good external appearance can be provided, and this vehicle antenna can withstand an outdoor environment of wind pressure, etc. only by simple fixation.

Figure 18:
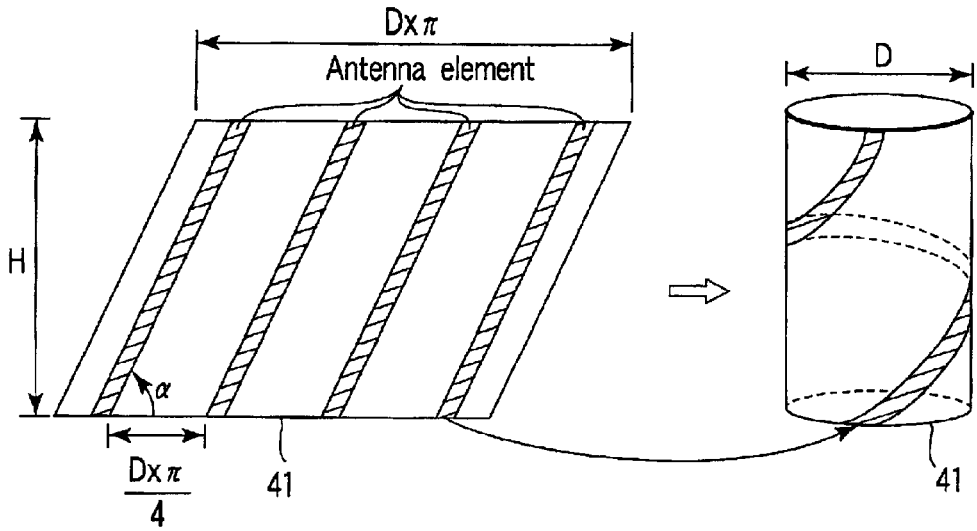
FIG. 18 illustrates a method of manufacturing a four-wire helical antenna 6 according to the first and second embodiments.

Referring to FIG. 18, a method of manufacturing the four-wire helical antenna 6 used in the first and second embodiments will be described. In an instance, copper foils each having a suitable width are formed on one side of a thin flexible base plate 41, as shown in FIG. 18. The copper foils are arranged with a pitch angle α at regular intervals of ¼ of the circumferential length calculated by D×π (D=diameter of antenna 6). The copper foils function as antenna elements.

Figure 19:
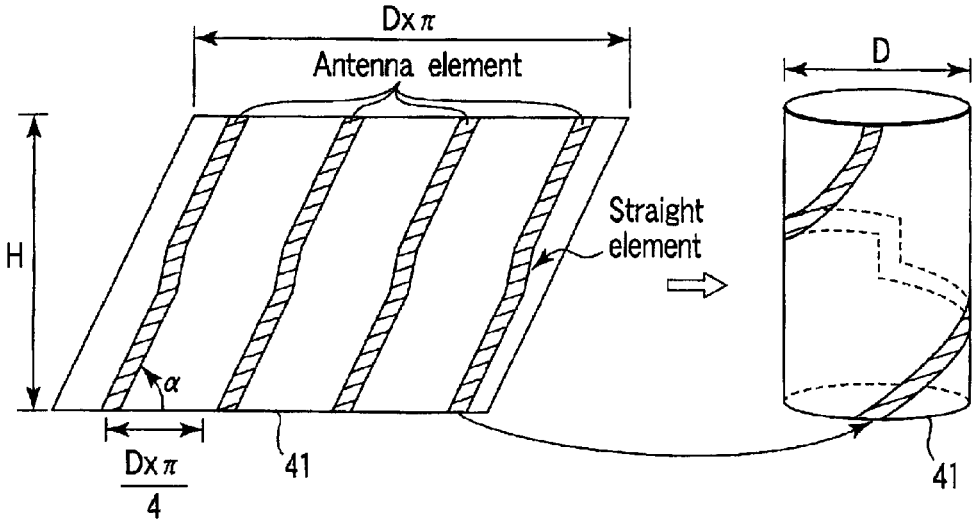
FIG. 19 illustrates a method of manufacturing a four-wire helical antenna 6 according to the third embodiment.

A method of manufacturing the four-wire helical antenna 14 of the third embodiment will be described with reference to FIG. 19. In FIG. 19, straight elements are formed midway in the copper foils in the manufacturing process illustrated in FIG. 18. By rolling the flexible base plate 41 in FIG. 18 (FIG. 19), the four-wire helical antenna is formed. With these methods, the manufacturing cost of the four-wire helical antenna can be reduced.

According to these methods, the propagation wavelength in the direction of the antenna elements of helical antenna 41 can be made shorter than the reception wavelength λ in accordance with the kind of dielectric material of the flexible base plate 41. Experimental data confirmed that when copper foils with a thickness of 35 μm were formed on a flexible base plate made of PET (polyethylene terephthalate) with a thickness of 100 λm, the propagation wavelength was about 90% of the reception wavelength λ. In short, the size of the antenna section can be further reduced by properly selecting the dielectric material of the flexible base plate 41.

Figure 20:
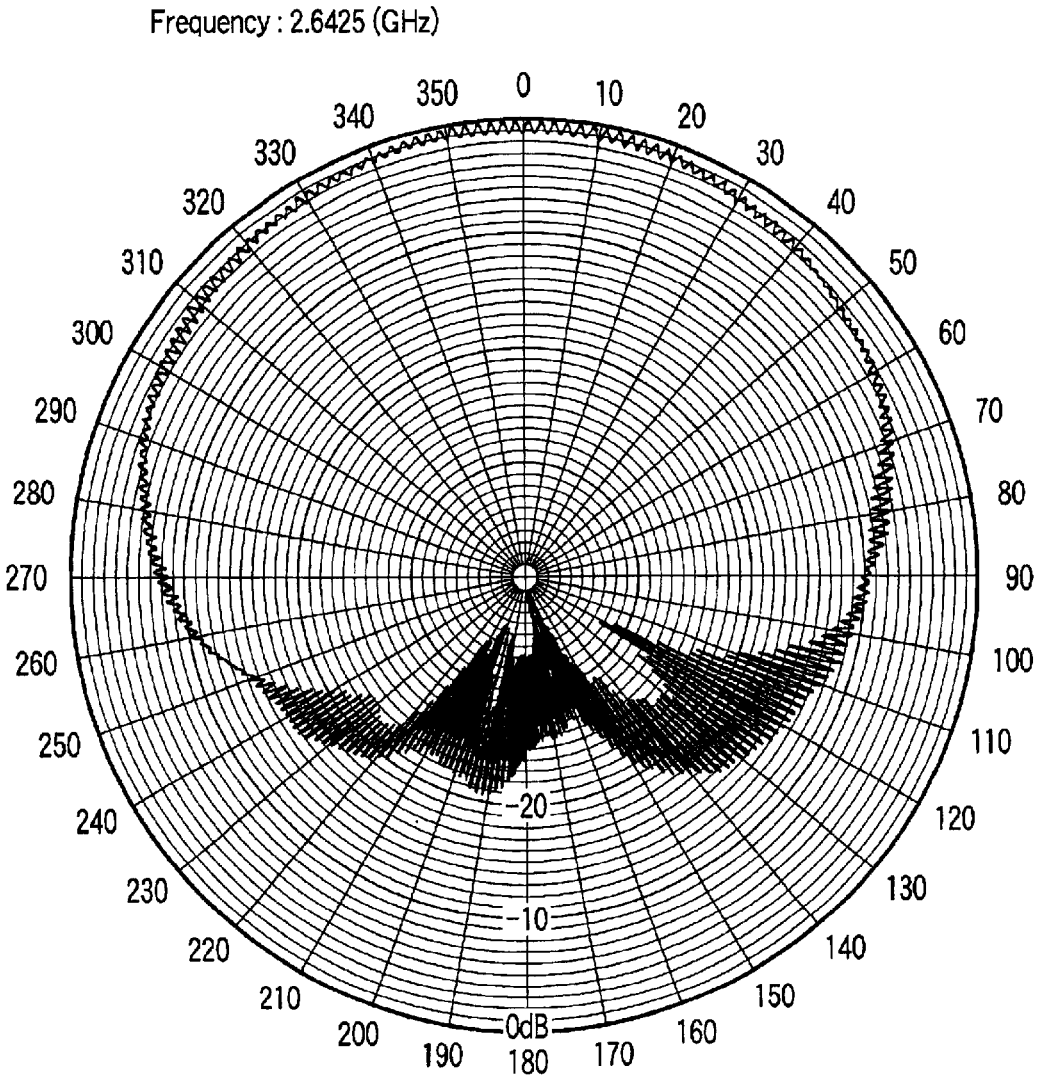
FIG. 20 is a graph showing a measured result of an axial ratio pattern of the helical antenna 6 shown in FIG. 12.

It was also confirmed by an experimental result that good axial ratio characteristics were obtained by setting the number of turns, T, at about 1. FIG. 20 is a graph showing a measured result of the axial ratio pattern of the helical antenna 6. It is understood from FIG. 20 that desired directivity and axial ratio were obtained.

In the embodiments described above, power is supplied to the antenna elements of the helical antenna, which are arranged with an angular distance of 90 therebetween, with a phase difference of 90°. When the reception wavelength is λ, the height H of the helical antenna section is set at 0.6 λ to 0.75 λ, the number of turns, T, of each antenna element is set at about 1, and the pitch angle α is set at 50 to 60°. In addition, the diameter of the ground conductor plate 2 provided on one side of the dielectric base plate 1 on which the helical antenna is attached is set at 0.5 λ to 1.0 λ. Moreover, the helical antenna is attached to the dielectric base plate 1 on the same side as, or on the opposite side to, the ground conductor plate 2.

In the third embodiment, the straight elements each with a length corresponding to about ¼ of the height H of the antenna are incorporated in the respective antenna elements of the four-wire helical antenna at locations corresponding to ½ to ¾ from the ground conductor plate. In this case, the height H of the helical antenna section is set at about 0.3 λ to 0.35 λ, the pitch angle α is set at about 22, and the number of turns, T, of each antenna element is set at about 1.

With the above structure, both radio waves from the satellite and radio waves coming in the substantially horizontal direction can be received without increasing the area or the size of the antenna apparatus. Furthermore, since the level of radiation directivity toward the vehicle is suppressed, a good reception sensitivity can be obtained.

Figure 21:
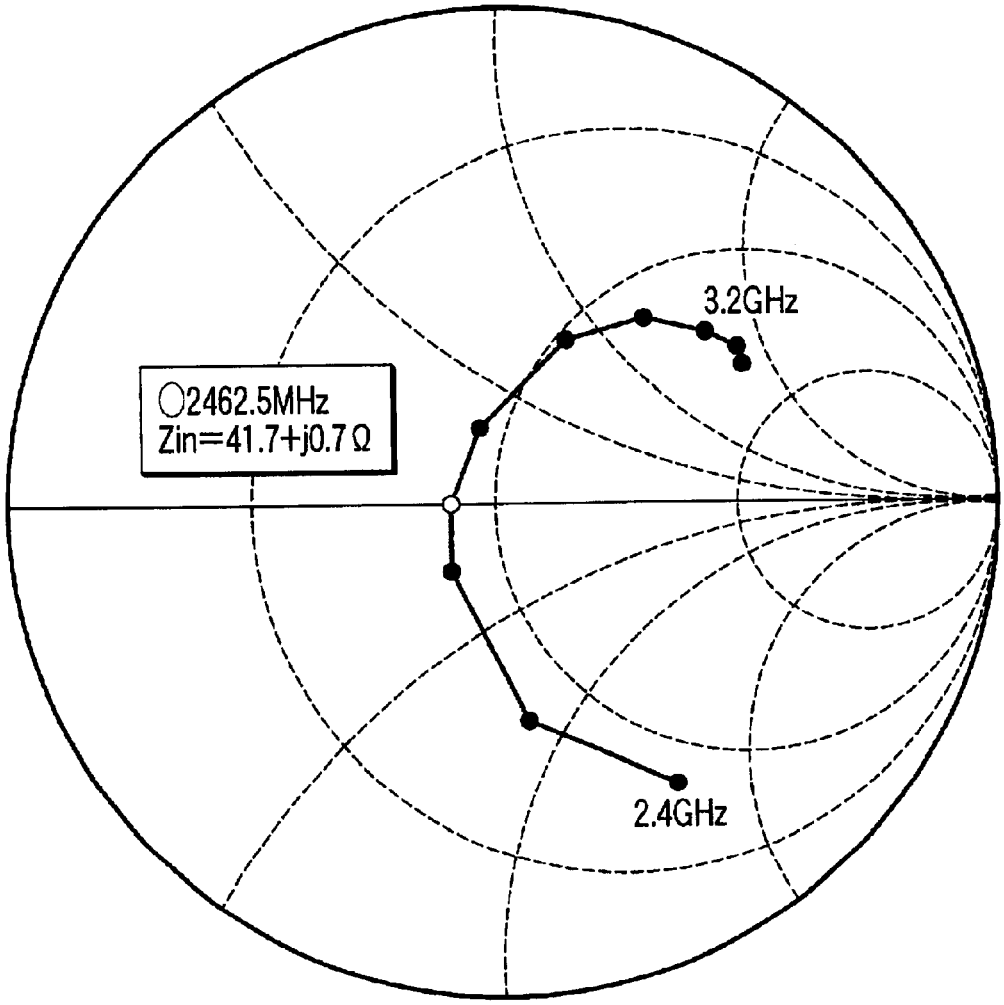
FIG. 21 is a graph showing a measured result of an input impedance of the helical antenna 6 shown in FIG. 12.

FIG. 21 is a graph showing a measured result of an input impedance of the helical antenna 6 according to this embodiment. As is shown in FIG. 21, with a center frequency of 2642.5 MHz, an impedance of 41.7+j0.7 Ω was obtained. This value is close to 50 Ω, which is an ordinary value for a power supply line of an antenna apparatus.

In this embodiment, the length of the antenna element of the helical antenna is set at about ¾ λ. With this length of the antenna element, the impedance of about 50 Ω, which is an ordinary value for a power supply line of an antenna apparatus, is obtained. Thereby, good matching with the power line is attained without the need to use a special matching circuit.

According to the structures of the second and third embodiments, the height of the antenna can be reduced, and the volume (size) of the antenna decreased. Thus, the reduction in size and cost can be achieved. Furthermore, there is provided an antenna apparatus which has a good external appearance and can withstand an outdoor environment of wind pressure, etc.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna apparatus comprising:

a base plate having one surface provided with a ground conductor;

a helical antenna section attached to the base plate and provided with an n-number of antenna-elements helically formed at an angular distance of (360/n)° therebetween, each antenna element including a straight portion extending parallel to the axis of the helical antenna section; and a radio frequency signal supplier which is provided on the other surface of the base plate and supplies power to the n-number of antenna elements of the helical antenna with a phase difference of (360/n)°;

said straight portion having a lenath corresponding to about one-fourth of the height of the helical antenna section.

2. An antenna apparatus according to claim 1, wherein said straight portion is formed at a location corresponding to ½ to ¾ of the height of the helical antenna section from the ground conductor.

3. An antenna apparatus according to claim 1, wherein when a reception wavelength is λ, the height of the helical antenna section is about 0.3 λ to 0.35 λ;

wherein the number of turns of each antenna element is about 1; and wherein each antenna element of the helical antenna section has a pitch angle of about 22°.

4. An antenna apparatus according to claim 1, wherein when a reception wavelength is λ, the length of each antenna element is 3/4 λ.

5. An antenna apparatus according to claim 1, wherein said helical antenna section is attached to a surface of the base plate, on which the radio frequency signal supplier is provided.

6. An antenna apparatus according to claim 1, wherein when a reception wavelength is λ, said ground conductor has a substantially circular shape with a diameter of 0.5 λ to 1.0 λ.

7. An antenna apparatus according to claim 1, further comprising a low noise amplifier which amplifies a received signal sent from the helical antenna section via the radio frequency signal supplier.

8. An antenna apparatus according to claim 1, further comprising a radome covering at least said helical antenna section.

9. An antenna apparatus according to claim 1, further comprising fixing means for fixing the antenna apparatus to a movable body.

* * * * *